US011203001B2

(12) United States Patent
Rosset et al.

(10) Patent No.: US 11,203,001 B2
(45) Date of Patent: Dec. 21, 2021

(54) MAGNETIC STIR BAR

(71) Applicant: Université de Genève, Geneva (CH)

(72) Inventors: Stéphane Rosset, Petit-Lancy (CH); Clément Mazet, Geneva (CH); Christophe Girard, Geneva (CH)

(73) Assignee: UNIVERSITÉ DE GENÈVE, Geneva (CH)

( * ) Notice: Subject to any disclaimer, the term of this patent is extended or adjusted under 35 U.S.C. 154(b) by 258 days.

(21) Appl. No.: 16/310,583

(22) PCT Filed: Jun. 16, 2017

(86) PCT No.: PCT/EP2017/064804
§ 371 (c)(1),
(2) Date: Dec. 17, 2018

(87) PCT Pub. No.: WO2017/216361
PCT Pub. Date: Dec. 21, 2017

(65) Prior Publication Data

US 2019/0262788 A1 Aug. 29, 2019

(51) Int. Cl.

| | |
|---|---|
| ***B22C 5/00*** | (2006.01) |
| ***B01F 13/08*** | (2006.01) |
| ***B01F 15/02*** | (2006.01) |
| ***B01F 7/00*** | (2006.01) |

(52) U.S. Cl.
CPC ..... *B01F 13/0818* (2013.01); *B01F 7/00066* (2013.01); *B01F 15/0215* (2013.01); *B01F 15/0224* (2013.01); *B01F 2215/0036* (2013.01)

(58) Field of Classification Search
CPC ..... B01F 13/0818; B01F 7/00066; B01F 15/0215; B01F 15/0224; B01F 2215/0036
See application file for complete search history.

(56) References Cited

U.S. PATENT DOCUMENTS

| | | | | |
|---|---|---|---|---|
| 3,749,369 | A * | 7/1973 | Landsberger | B01F 13/0818 366/273 |
| 2007/0189115 | A1* | 8/2007 | Yaniv | B01F 13/0827 366/274 |
| 2008/0220539 | A1* | 9/2008 | Brauner | B01F 13/0059 436/536 |
| 2010/0014379 | A1 | 1/2010 | Wright | |
| 2015/0023132 | A1* | 1/2015 | Werth | B01F 15/0085 366/273 |

FOREIGN PATENT DOCUMENTS

| | | | |
|---|---|---|---|
| JP | 2005046822 | A | 2/2005 |
| WO | 2007/053870 | A2 | 5/2007 |
| WO | 2011/098570 | A2 | 8/2011 |

* cited by examiner

*Primary Examiner* — Anshu Bhatia
*Assistant Examiner* — Gregory Y Huan
(74) *Attorney, Agent, or Firm* — Thomas Coester Intellectual Property

(57) ABSTRACT

Magnetic stir bar having at least one permanent magnet to spin the magnetic stir bar when the magnetic stir bar is subjected to a rotating magnetic field. The magnetic stir bar has a chamber to store a product within the magnetic stir bar. The magnetic stir bar has a closed configuration in which the chamber is closed and an open configuration in which the chamber is open. The magnetic stir bar automatically reconfigures itself from the closed configuration to the open configuration when said magnetic stir bar is spun at or above a threshold rotational speed.

9 Claims, 7 Drawing Sheets

MAGNETIC STIR BAR

The present invention relates to a magnetic stir bar for use with a magnetic stirrer. The present invention relates in particular to a magnetic stir bar configured for releasing a product contained therein in a controlled manner into the stirred solution.

Magnetic stirrers, or magnetic mixers, are laboratory devices used for example in chemistry and/or in biology for mixing solutions. A magnetic stirrer typically comprises a rotating magnet or an assembly of electromagnets for generating a rotating magnetic field. A magnetic stir bar immersed in a liquid is spun under the effect of the rotating magnetic field, thereby stirring the liquid. Magnetic stirrers usually comprise a receiving surface for receiving a vessel containing a liquid to be mixed and a magnetic stir bar. The rotating magnetic field is generated under the receiving surface, i.e. under the vessel, thereby rotating the magnetic stir bar, which is inside the vessel and immersed in the liquid. Vessels used with magnetic stirrers are usually made of glass, or of any other material that does not significantly affect magnetic fields.

Magnetic stir bars typically comprise an elongated magnet coated in a chemically inert material, such as for example, but not exclusively, polytetrafluoroethylene (hereafter PTFE). In their simplest and most common fan, magnetic stir bars are bar shaped and have a circular or polygonal cross-section. Magnetic stir bars however may have various shapes or configurations in order for example to optimize their stirring effect and/or to adapt them to specific applications and/or vessels.

Some chemical or biological reactions require the use of compounds, for example reagents, reactants and/or catalysts, that are sensitive to environmental conditions, for instance to oxygen, humidity, light, etc. and that must be stored and handled in protected environments in order to preserve their properties.

Chemical or biological reactions using such compounds must therefore be performed in a controlled environment in order to avoid an alteration of the sensitive compounds' properties for example while they are being added to the mixture. Such chemical or biological reactions are for example performed in glove boxes. Glove boxes are hermetic enclosures in which the atmosphere can be controlled, for example by creating vacuum, by filling the enclosure with a specific gas, for example an inert gas, by controlling the temperature and/or humidity within the enclosure, etc. An operator then manipulates the elements located within the enclosure by placing his or her hands in plastic gloves that reach through the wall of the enclosure. Glove boxes, however, are expensive and cumbersome pieces of equipment and their use is time-consuming. Many laboratories are therefore not equipped with glove boxes.

In order to avoid having to use a glove box, solutions have been proposed, where the sensitive compounds are encapsulated in capsules made of a material, for example wax or cellulose, that dissolves in a liquid environment. The capsules are filled with the sensitive compound, and closed, under controlled environmental conditions and may then be stored for a limited time under normal environmental conditions before use. When the sensitive compound is needed for a reaction, a corresponding capsule is placed, typically under normal environmental conditions, in a vessel containing a liquid and the mixture is stirred using for example a magnetic stirrer. The capsule's material often requires some heating of the solution to dissolve and thereby release the sensitive compound into the liquid.

A disadvantage of such capsules is that they usually require heating the mixture for them to dissolve. Another disadvantage is that the melted capsule's material remains in the resulting mixture. Still another disadvantage is that the material used for forming the capsule, for example cellulose, is not completely hermetic and stable, such that the properties of the compound in the capsule may be altered over time. The capsule must therefore be used or discarded within a given time, which results in complicated and costly stock management, and possibly high waste rate.

There is thus a need for an easy, cost effective and reliable device and method for efficiently and reliably storing and releasing sensitive compounds under normal environmental conditions without altering their properties.

An aim of the present invention is to provide a device and a method responding to these needs.

This aim and other advantages are achieved with a device and a method according to the corresponding independent claim.

This aim and other advantages are achieved in particular with a magnetic stir bar for use with a magnetic stirrer, wherein the magnetic stir bar comprises at least one permanent magnet for spinning the magnetic stir bar when it is subjected to a rotating magnetic field; and a chamber for storing a product inside the magnetic stir bar, wherein the magnetic stir bar has a closed configuration in which the chamber is closed, the magnetic stir bar being maintained in the closed configuration under the effect of a first force, and an open configuration in which the chamber is open, the magnetic stir bar being maintained in the open configuration under the effect of a second force, and wherein the magnetic stir bar is adapted to automatically reconfigure itself from the closed configuration to the open configuration when the magnetic stir bar is spun at or above a threshold rotational speed.

The first force and the second force are for example magnetic forces induced by the at least one permanent magnet.

In embodiments, the second force is stronger than the first force.

The threshold rotational speed is for example comprised in a range going from 300 rpm to 1200 rpm, for example approximately 800 rpm.

In embodiments, the magnetic stir bar comprises a first part and a second part detachable from the first part, each part comprising at least one permanent magnet, a cavity forming at least part of the chamber when the magnetic stir bar is in the closed configuration, wherein the at least one permanent magnet of each part is positioned within the part such that they attract each other when the magnetic stir bar is in the closed position and when the magnetic stir bar is in the open position.

The at least one permanent magnet of each part is for example positioned within the part such that the at least one magnet in the first part and the at least one magnet in the second part are closer to each other when the magnetic stir bar is in the open configuration than they are when the magnetic stir bar is in the closed configuration.

The first part and the second part are for example configured such that a centrifugal force applied to the first part and a centrifugal force applied to the second part when the magnetic stir bar is spun above or at the threshold rotational speed, are equal to or greater than the first force.

In embodiments, the magnetic stir bar comprises tightening means for hermetically closing the chamber when the magnetic stir bar is in the closed configuration.

In embodiments, the chamber comprises a plurality of compartments that are separated from each other when the magnetic stir bar is in the closed configuration.

This aim and other advantages are achieved in particular with a method for releasing a product in a stirred solution with a magnetic stir bar of the invention, the method comprising the steps of placing the magnetic stir bar in the closed configuration in the solution, spinning the magnetic stir bar using a rotating magnetic field and increasing the rotational speed of the magnetic stir bar up to a threshold rotational speed.

Thanks to the magnetic stir bar of the invention, the steps of placing and spinning are preferably performed at normal environmental conditions.

In embodiments, the method comprises the preliminary step of pre-filling under controlled atmospheric conditions the chamber of the magnetic stir bar with a sensitive compound.

In embodiments, the method further comprises assembling the magnetic stir bar in the closed configuration under controlled atmospheric conditions after the step of pre-filling.

The present invention will be better understood by reading the following description illustrated by the figures, where FIG. 1 is a schematic cut view of a magnetic stir bar according to an embodiment of the invention in a closed configuration;

Figure 4:
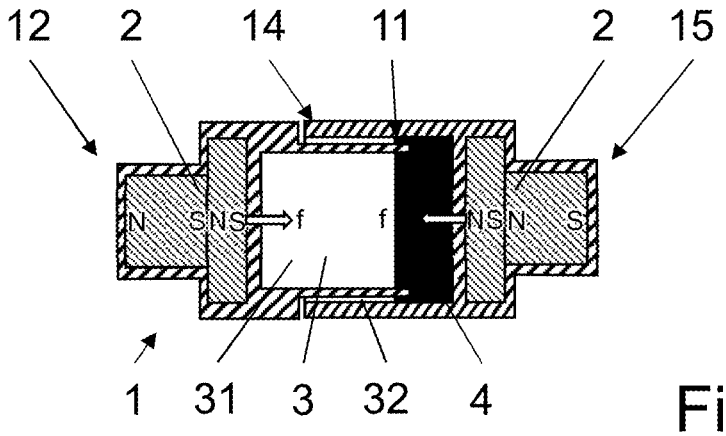
FIG. 4 is a schematic cut view of a magnetic stir bar according to a preferred embodiment of the invention in a closed configuration.
Figure 7A:
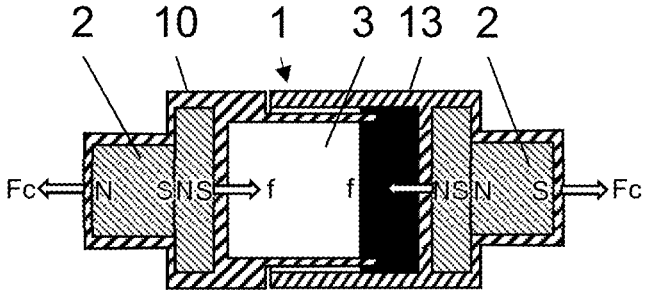
Figure 7B:
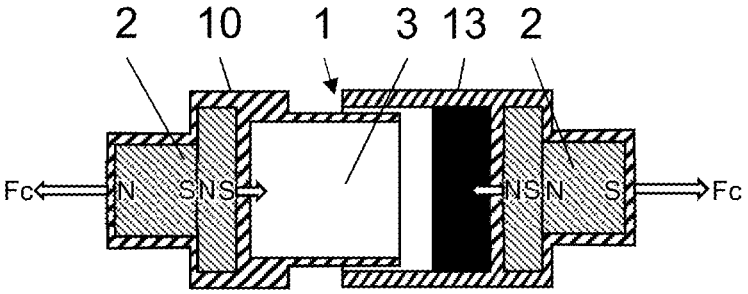
Figure 7C:
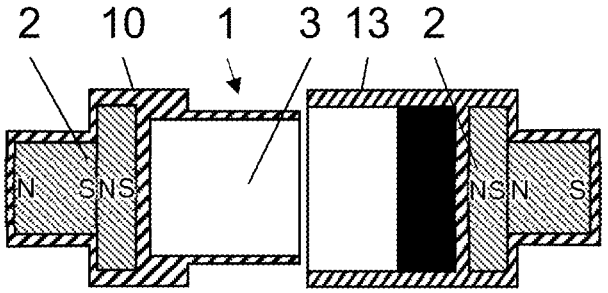
Figure 7D:
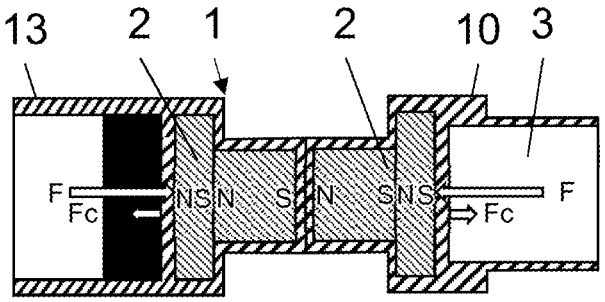
Figure 7E:
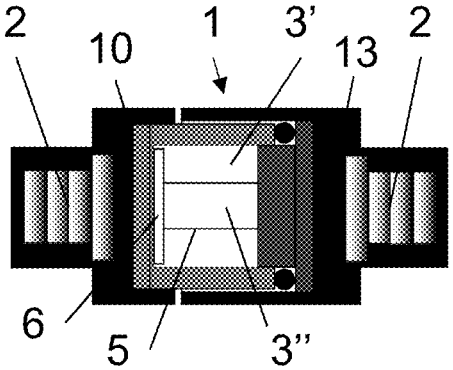
Figure 7F:
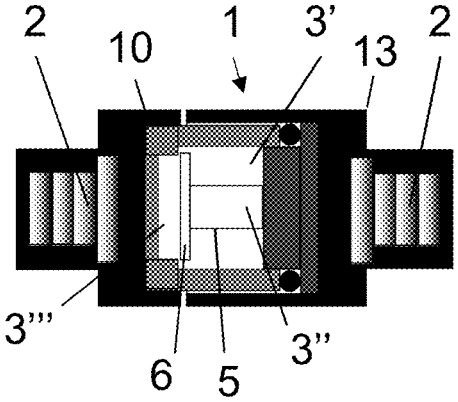

FIGS. 7*a* to 7*d* schematically illustrate the magnetic stir bar of FIG. 4 automatically going from the closed configuration to the open configuration under the effect of centrifugal forces;

FIGS. 7*e* and 7*f* schematically illustrate the magnetic stir bar of FIG. 7*a* with two and three compartments.

Figure 8:
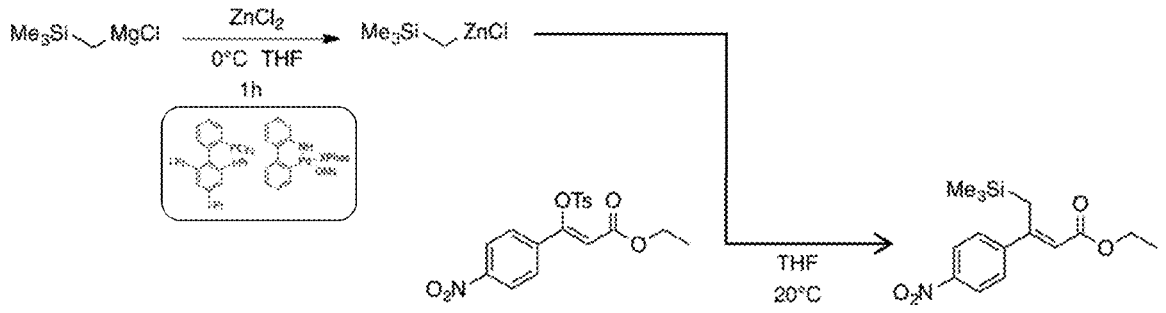
Figure 9:
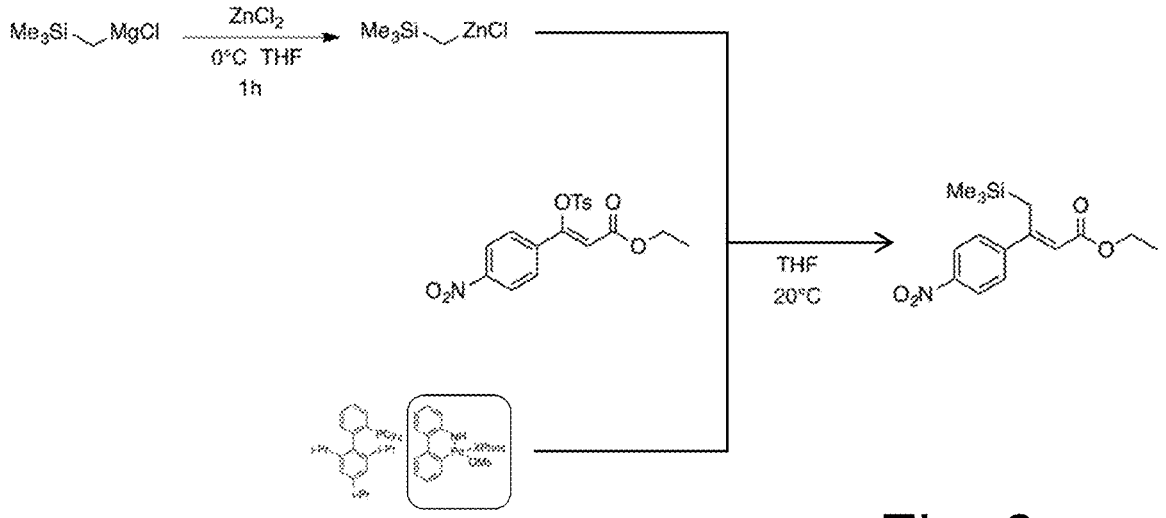
Figure 10:
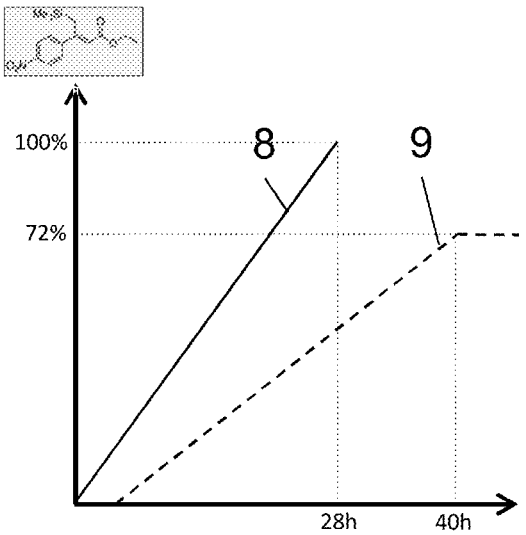

FIG. 8 schematically illustrates a chemical reaction using the magnetic stir bar of the invention for releasing a sensitive catalyst into the solution;

FIG. 9 schematically illustrates the same chemical reaction as the one illustrated in FIG. 8, using a cellulose capsule for releasing the sensitive catalyst into the solution;

FIG. 10 compares the conversion rate and conversion speed of the reactions illustrated in FIGS. 8 and 9.

Figure 11:
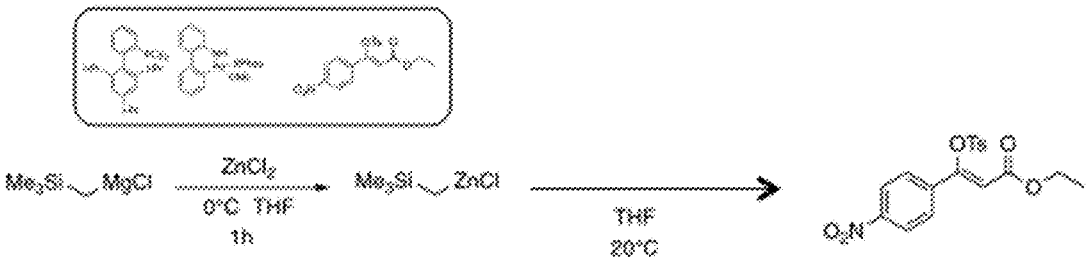
Figure 12:
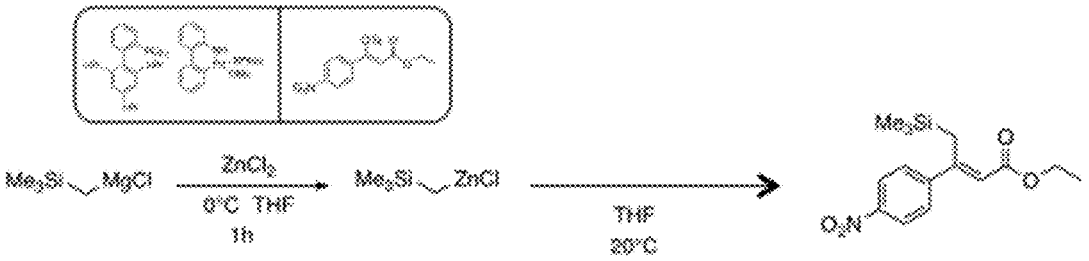
Figure 13:
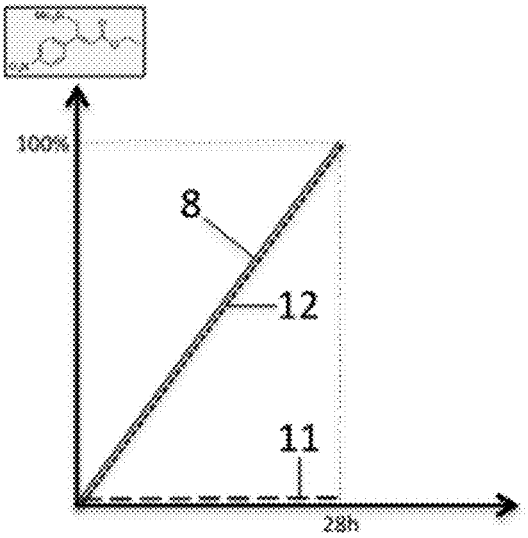

FIG. 11 schematically illustrates the same chemical reaction as the one illustrated in FIG. 8, where the organic compound is placed in the chamber of the magnetic stir bar mixed with the catalysts;

FIG. 12 schematically illustrates the same chemical reaction as the one illustrated in FIG. 11, where the organic compound is placed in a second chamber of the magnetic stir bar separated from the chamber containing the catalysts;

FIG. 13 compares the conversion rate and conversion speed of the reactions illustrated in FIGS. 8, 11 and 12.

Figure 14:
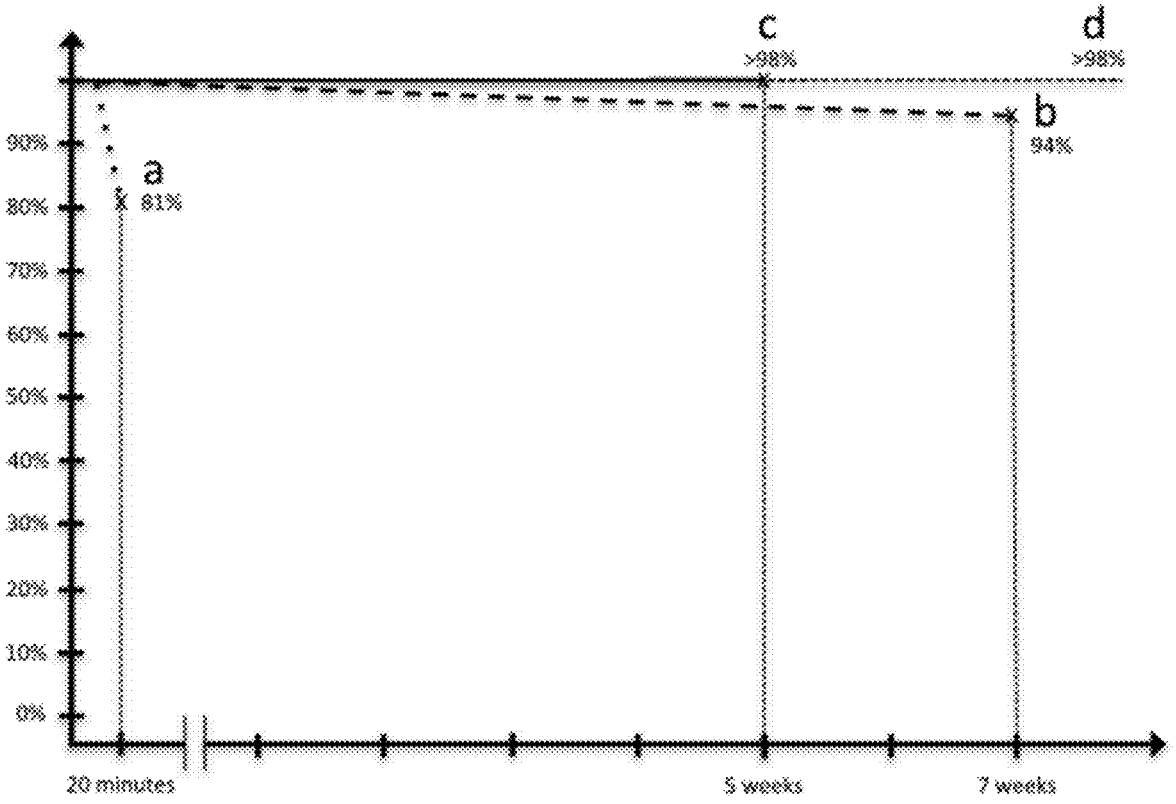

FIG. 14 illustrates a sealing efficiency of the magnetic stir bar.

Figure 1:
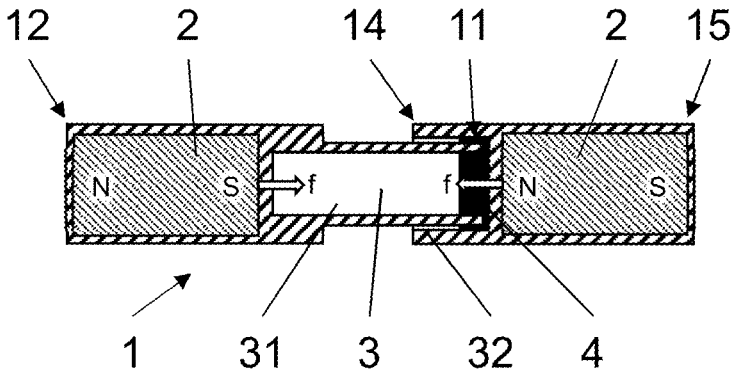

With reference to FIG. 1, the magnetic stir bar 1 of the invention comprises at least one permanent magnet, for example two permanent magnets 2, and a chamber 3 for containing a product, for example a liquid or a solid chemical or biological compound, or a mixture of products.

Figure 2:
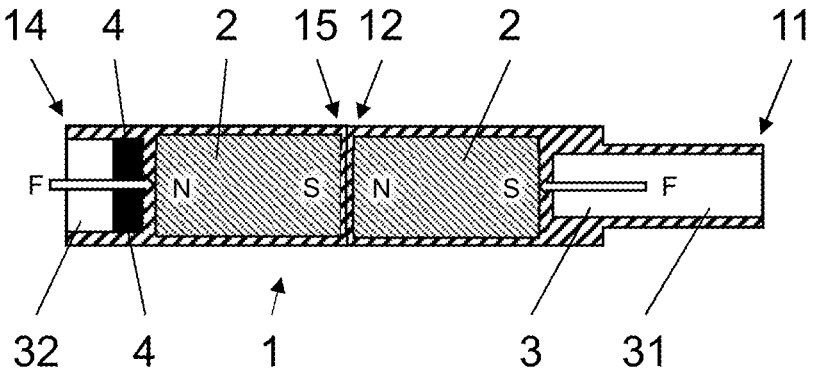
FIG. 2 is a schematic cut view of the magnetic stir bar of FIG. 1 in an open configuration.

According to the invention, the magnetic stir bar 1 has at least two stable configurations: a closed configuration illustrated for example in FIG. 1 in which the chamber 3 is closed, and an open configuration illustrated for example in FIG. 2 in which the chamber 3 is open, wherein the magnetic stir bar 1 is maintained in the closed configuration under the effects of a first force f and maintained in the open configuration under the effects of a second force F. The first and second forces f, F are for example magnetic forces induced by the mutual attraction of the permanent magnets 2.

Figure 3:
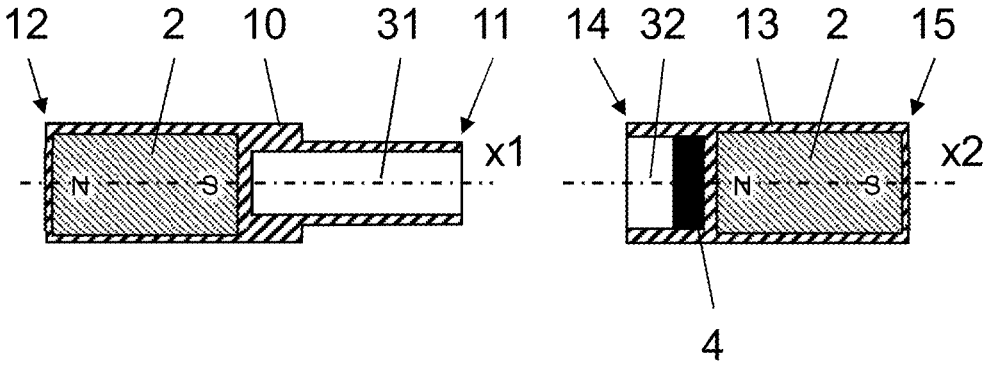
FIG. 3 is a schematic cut view of the disassembled magnetic stir bar of FIG. 1.

With reference to FIG. 3, the magnetic stir bar 1 for example comprises two parts 10, 13 that are detachable from each other, each part 10, 13 comprising a permanent magnet 2. The parts 10, 13 are configured such that they can be assembled to form the magnetic stir bar in the closed configuration as illustrated in FIG. 1, or to form the magnetic stir bar in the open configuration as illustrated in FIG. 2.

Each part 10, 13 for example comprises an elongated body, for example a cylindrical body, each part having a proximal end 11, 14 and a distal end 12, 15 along their respective longitudinal axis x1, x2. The proximal end 11, 14 of each part 10, 13 for example comprises a cavity 31, 32 that forms at least part of the chamber 3 when the magnetic stir bar 1 is in the closed configuration. The chamber 3 of the magnetic stir bar 1 in the closed configuration is for example formed in that the two parts 10, 13 are assembled with their proximal ends 11, 14 attached to each other. In the closed configuration, the proximal end 11 of a first part 10 is for example at least partly inserted into the cavity 32 of the proximal end 14 of a second part 13. In order to form the magnetic stir bar 1 in the open configuration, the two parts 10, 13 are for example assembled with their distal ends 12, 15 attached to each other, thereby leaving the cavities 31, 32 open.

The permanent magnets 2 are positioned within each part 10, 13 with their poles N, S aligned along the longitudinal axis x1, x2 of the respective part 10, 13 and oriented such that they magnetically attract each other when the parts 10, 13 are assembled to fan the magnetic stir bar 1 in the closed configuration or to form the magnetic stir bar 1 in the open configuration. Preferably, the magnets 2 are positioned closer to the distal end 12, 15 of the respective part 10, 13 than they are to the proximal end 11, 14, such that they are closer to each other when the magnetic stir bar 1 is in the open configuration than they are when the magnetic stir bar 1 is in the closed configuration, such that the second force F is consequently stronger than the first force f.

When the magnetic stir bar 1 of the invention is in the closed configuration, the chamber 3 is preferably hermetically closed in order to avoid any leakage outside the chamber 3 of a product contained therein and/or to prevent any product contained in the chamber 3 from being in contact with the environment outside the closed magnetic stir bar 1. In embodiments, the magnetic stir bar 1 comprises tightening means 4 to achieve a tight contact between the two parts 10, 13, in particular between the proximal ends 11, 14 of the two parts 10, 13, when the magnetic stir bar 1 is in the closed configuration. The tightening means for example comprise a padding 4 at the bottom of the cavity 32 of the second part 13 that ensures a tight contact with the periphery of the cavity 31 of the first part 10 when the magnetic stir bar is in the closed configuration. A groove is for example formed in the padding 4 to tightly receive the proximal end 11 of the first part 10. In embodiments, the padding 4 is made of a for example soft and preferably air- and water tight material that follows the shape of the proximal end 11 of the first part 10 when the chamber 3 is closed. Other tightening means are however possible within the frame of the invention. The tightening means however preferably do not induce additional friction forces while the two parts 10, 13 are being separated from each other.

The body of both parts 10, 13 of the magnetic stir bar 1 is preferably made of an inert material, for example PFTE, or a combination of inert materials, in order to avoid any contamination of the product contained in the closed chamber 3 and/or of the stirred mixture. The permanent magnets 2 are for example high quality and strong permanent magnets, for example SmCo permanent magnets.

Figure 5:
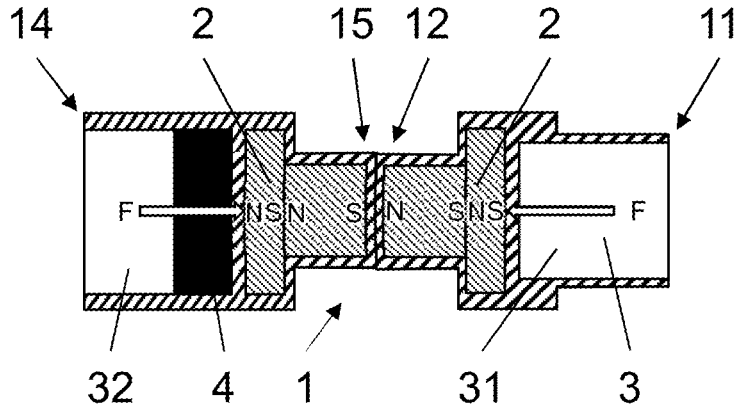
FIG. 5 is a schematic cut view of the magnetic stir bar of FIG. 4 in an open configuration.
Figure 6:
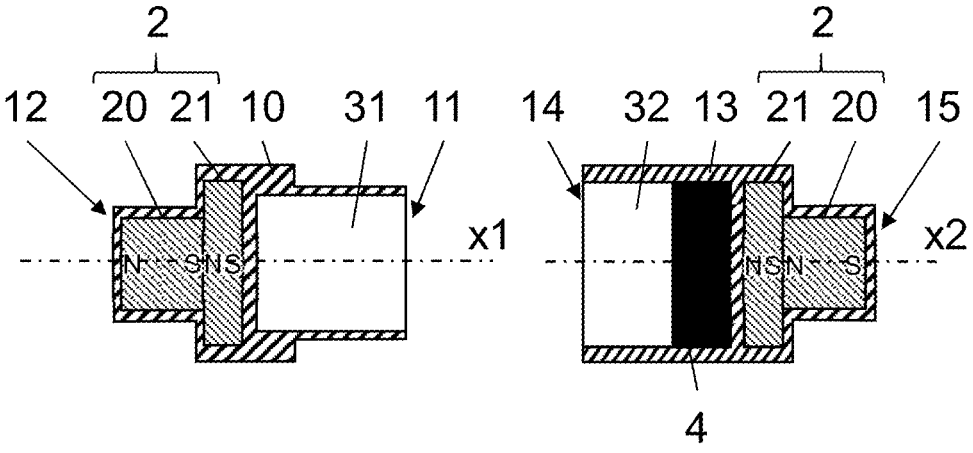
FIG. 6 is a schematic cut view of the disassembled magnetic stir bar of FIG. 4.

In a preferred embodiment illustrated in FIGS. 4, 5 and 6, the distal end 12, 15 of each part 10, 13 has a smaller radial dimension, i.e. a smaller dimension in a direction perpendicular to the respective longitudinal axis x1, x2, than the corresponding proximal end 11, 14. In a cylindrical configuration of the parts 10, 13, for example, the diameter of the distal end 12, 15 of each part 10, 13 is smaller than the diameter of the corresponding proximal end 11, 14. Experiments have shown that this configuration of parts 10, 13 provides a better stability to the magnetic stir bar 1 when spun both in the open and in the closed configurations. Accordingly, each permanent magnet 2 for example comprises a cuboid magnet 20 and a disc magnet 21 attached or close to each other, wherein the cuboid magnet 20 is closer to the distal end 12, 15 than the disc magnet 21.

The remaining elements and properties of the magnetic stir bar illustrated in FIGS. 4, 5 and 6 are identical or similar to those of the magnetic stir bar of the invention described above in relation with the embodiment of FIGS. 1 to 3. The same reference numbers designate the same or similar elements in all figures.

According to the invention, and as illustrated in FIGS. 7*a* to 7*d*, the magnetic stir bar 1 is configured such that it automatically reconfigures itself by going from the closed configuration to the open configuration when it is spun above a determined threshold rotational speed.

When the magnetic stir bar 1 spins, for example under the effect of the rotational magnetic field of a magnetic stirrer, an inertial or centrifugal force Fc acts on each part 10, 13, in a direction opposite to the direction of the mutual magnetic attraction force of the permanent magnets 2, for example the first force f maintaining the magnetic stir bar 1 in the closed configuration (FIG. 7*a*).

The centrifugal force Fc can be calculated according to the following formula:

$$Fc=m\cdot\omega^2\cdot R$$

where m is the mass in rotation, ω is the rotational speed and R is the radius from the center of rotation to the center of gravity of the rotating mass.

In order to open the chamber 3, the rotational speed ω of the magnetic stir bar 1 is increased until a threshold rotational speed ωt is reached, at which the centrifugal force Fc acting on each part 10, 13 of the closed magnetic stir bar 1 is stronger than the sum of the first force f and possible friction forces that maintain the magnetic stir bar in the closed configuration. Under the effects of the centrifugal forces Fc, the parts 10, 13 start moving away from each other (FIG. 7*b*). As the parts 10, 13 move away from each other, and provided that the rotational speed ω is maintained at or above the threshold rotational speed ωt, the centrifugal forces Fc further increase since the radius R between the center of rotation and the center of gravity of each part 10, 13 increases, while the magnetic attraction forces between the permanent magnets 2 decrease since the distance between the two permanent magnets 2 increases, thereby increasing the opening speed of the chamber 3 and thus ensuring a rapid release in the stirred mixture of the product contained in the chamber 3.

Once the chamber 3 is open and the parts 10, 13 are completely separated from each other (FIG. 7*c*), they each rotate separately under the effect of the rotational magnetic field until their respective distal ends 12, 15 come close to each other and then attach to each other under the effect of the second force F generated by the mutual attraction of the permanent magnets 2, thereby reconfiguring the magnetic stir bar 1 in the open configuration (FIG. 7*d*).

The magnetic stir bar 1 is then for example further rotated in the open configuration in order to further stir the mixture as long as required by the chemical or biological reaction. The second force F that maintains the magnetic stir bar 1 in the open configuration is stronger than the first force f. The rotational speed of the magnetic stir bar 1 may thus be maintained slightly above the threshold rotational speed ωt or decreased below the threshold rotational speed ωt without any risk of reconfiguration of the magnetic stir bar 1 in the closed configuration, because the second force F is stronger than the centrifugal forces applied at these speeds on the parts 10, 13 of the magnetic stir bar 1.

The threshold rotational speed ωt may depend on the geometry and configuration of the magnetic stir bar 1. The threshold rotational speed ωt is preferably high enough that the magnetic stir bar 1 may be used to efficiently stir a solution in the closed configuration without any risk of accidentally opening, and not too high in order to avoid spilling the solution or breaking the container when the magnetic stir bar 1 is to be opened. The threshold rotational speed ωt is for example comprised in a range going from 300 rpm to 1200 rpm.

Example

In an exemplary but in no way limiting embodiment, the mass of a first part 10 is for example m1=7.82 g and the mass of a second part 13 is for example m2=7.98 g. The first force maintaining the magnetic stir bar 1 in the closed configuration, which essentially comprises the force of mutual attraction of the permanent magnets 2 and possibly some frictional forces, was measured with a dynamometer to be for example f=0.8 N. The second force maintaining the magnetic stir bar 1 is in the open configuration, which almost exclusively comprises the force of mutual attraction of the permanent magnets 2 was measured for example to be F=8.2 N. The distance between the center of gravity of the magnetic stir bar in the closed configuration and the center of gravity of each part 10, 13 is for example R=14.5 mm.

The threshold rotational speed ωt above which the magnetic stir bar starts opening is thus a rotational speed at which the centrifugal force Fc exerted on each part 10, 13 is at least equal to f=0.8 N.

$$\omega=\sqrt{\frac{Fc}{m\cdot R}}=\sqrt{\frac{0.8\,[N]}{\frac{7.82+7.98}{2}\cdot 10^{-3}[\mathrm{kg}]\cdot 14.5\cdot 10^{-3}[\mathrm{m}]}}=83.57\left[\frac{\mathrm{rad}}{s}\right]$$

where $$83.57\left[\frac{\mathrm{rad}}{s}\right]=\frac{83.57\cdot 60}{2\cdot\pi}[\mathrm{min}^{-1}]\cong 800[\mathrm{min}^{-1}]$$

In the present example, the threshold rotational speed ωt at which the magnetic stir bar automatically opens while stirring the mixture is thus approximately 800 rpm.

In the embodiments described above, the magnetic stir bar of the present invention comprises two parts that are detachable from each other and that form the close chamber when they are assembled together in the closed configuration. Other embodiments of the magnetic stir bar are however possible within the frame of the invention. In embodiments, the magnetic stir bar is for example essentially made of a single and at least partly hollow part, in which the chamber is formed. The chamber is for example closed by a door, for example a hinged or a sliding door, which is maintained closed, i.e. in the closed configuration, by the force of a spring or any other appropriate means. When the magnetic stir bar is spun at or above a threshold rotational speed, the centrifugal force acting on the door forces it open against the force of the spring. Once open, the door is for example maintained open, i.e. in the open configuration, by the force of a second spring, which is for example stronger than the first spring or other means.

In embodiments illustrated in FIGS. 7*e* and 7*f*, the chamber of the magnetic stir bar of the invention comprises a plurality of compartments that are completely separated from each other when the magnetic stir bar is in the closed configuration. This allows for example storing two or more sensitive compounds in the closed magnetic stir bar that should not be in contact with each other before their release in the stirred solution. The compartments for example divide the chamber in sections, are concentric, or are of any other appropriated shape and/or combination of shapes.

In the embodiment, of FIG. 7*e*, the magnetic stir bar 1 comprises two compartments 3' and 3" separated by a separation wall 5, the total volume of which being equal to the volume 3 of the "single-compartment" magnetic stir bar minus the separation wall volume 5. Ideally, the separation wall 5 is of the same general shape as the magnetic stir bar 1, i.e. preferably cylindrical, this is however not mandatory. If cylindrical, the general shape will look like two concentric cylinders 3' and 3". Further, the said separation wall 5, also called partition wall can be fixed to one or the other magnetic stir bar parts 10, 13 and can be permanently fixed to the interior of the magnetic stir bar or it can be a detachable piece which merely added when needed. FIG. 7*e* actually shows a third possibility which is a detachable piece comprising a partition wall 5 and a centering wall 6. In order to provide sealed compartments, the length of the partition wall is obviously at least equal or superior to the length of the volume 3 (i.e. in the longitudinal direction) when the two parts are not moved away from each other. Further, seals of any conventional material may be added.

As explained, with such a separation wall 5, when the magnetic stir bar 1 spins, for example under the effect of the rotational magnetic field of a magnetic stirrer, the inertial or centrifugal force Fc acts on each part 10, 13, in a direction opposite to the direction of the mutual magnetic attraction force of the permanent magnets 2, for example the first force f maintaining the magnetic stir bar 1 in the closed configuration (FIG. 7*a*) and therefore the magnetic stir bar which contains two different products can therefore provide a separation between the compartments 3' and 3" and the products can be released simultaneously upon agitation at a determined velocity when opening of the volume 3' and 3" to the exterior.

In the same manner, FIG. 7*f* shows an alternative magnetic stir bar comprising three compartments 3', 3" and 3'''.

Ideally, here the principle is almost the same as the two-compartment magnetic stir bar 1 since we still have the two concentric compartments 3' and 3" and in addition we have a third compartment 3''' which is provided as a recess constituted by an insert having a ring shape which is either a mobile element or provided within the bottom wall. In any case the insert is provided in addition to the bottom wall. By bottom wall we intend the wall separating the magnet 2 and the volume 3, 3' or 3".

This volume 3''' which is separated from volumes 3, 3' or 3" by a second partition wall 6 transversal, preferably perpendicular, to the magnetic stir bar longitudinal direction which is the left-right horizontal direction in the drawings.

As previously, the separation wall 5 is of the same general shape as the magnetic stir bar, i.e. preferably cylindrical, this is however not mandatory. If cylindrical, the general shape will look like two concentric cylinders 3' and 3". In order to provide sealed compartments, the length of the partition wall is obviously at least equal or superior to the length of the volume 3 when the two parts are not moved away from each other. Further, seals of any conventional material may be added.

With such a separation wall, when the magnetic stir bar 1 spins, for example under the effect of the rotational magnetic field of a magnetic stirrer, the inertial or centrifugal force Fc acts on each part 10, 13, in a direction opposite to the direction of the mutual magnetic attraction force of the permanent magnets 2, for example the first force f maintaining the magnetic stir bar 1 in the closed configuration (FIG. 7*a*) and therefore the magnetic stir bar which contains three different products can therefore provide a communication between the compartments 3', 3" and 3''' upon movement of the parts and the products can be mixed upon agitation at a determined velocity before opening of the volume 3', 3" and 3''' to the exterior.

Experiments

FIG. 8 illustrates a chemical synthesis reaction using the magnetic stir bar of the invention.

The chamber of the magnetic stir bar is pre-filled with for example a mixture of two catalysts, of which at least one is sensitive to normal environmental conditions. The magnetic stir bar is for example pre-filled in a glove box at a remote location. The closed magnetic stir bar containing the catalysts is placed in a vessel containing a solvent, for example THF, and two reagents. The vessel is placed on a magnetic stirrer and the magnetic stir bar is rotated below the threshold rotation speed, for example at 400 rpm, until the reagents recombine for forming the desired reactant. Once the desired reactant is obtained, an organic compound is for example added to the solution and the rotational speed of the magnetic stir bar is increased to the threshold rotational speed, for example 800 rpm, or above in order to quickly open the chamber and release the catalysts contained therein. Once the magnetic stir bar is in the open configuration, the rotational speed is for example reduced, for example to 400 rpm again, and the mixture is stirred with the magnetic stir bar in the open configuration until the desired synthesis by combination of the organic compound and the reactant is achieved.

According to the invention, even though the chemical reaction requires the use of at least one sensitive catalyst, the process described above may be performed in normal environmental conditions, in particular, the magnetic stir bar containing the sensitive catalyst may be handled and added to the mixture in normal environmental conditions, because the catalysts are protected from any contamination until their controlled release directly in the stirred solution.

FIG. 9 illustrates the same chemical reaction performed with the sensitive catalyst encapsulated in a soluble material, for example cellulose. The reagents and the solvent, for example THF, are introduced in a vessel, which is placed on a magnetic stirrer, and the solution is stirred with a conventional magnetic stir bar until the reagents recombine for forming the desired reactant. Once the desired reactant is obtained, the organic compound and the catalysts, including the sensitive catalyst encapsulated in a soluble material, are then introduced in the solution, which is further stirred. The capsule of soluble material slowly melts and thus slowly releases the catalyst contained therein directly in the solution. The dissolution of the capsule however takes some time that is not predictable. The moment and the speed of releasing the sensitive catalyst in the stirred solution is thus not controlled. Furthermore, in some cases, depending for example on the nature of the soluble material and/or of the solution, the heat of the solution may have to be increased above the optimal reaction temperature in order to solve the capsule.

FIG. 10 illustrates the efficiency of the process using the magnetic stir bar of the invention, compared to the efficiency of the same process using the encapsulated catalyst. Experiments have shown that using the magnetic stir bar of the invention allowed achieving up to 100% synthesis rate in approximately 28 hours, as shown by curve 8, while the process using catalysts encapsulated in soluble material, for example cellulose, only allowed achieving 72% synthesis rate after 40 hours, as shown by curve 9.

FIG. 11 illustrates the same chemical reaction as on FIG. 8. In this case the organic compound is placed in the chamber of the magnetic stir bar mixed with the catalysts. The magnetic stir bar is for example pre-filled in a glove box at a remote location. The closed magnetic stir bar containing the catalysts and the organic compound is placed in a vessel containing a solvent, for example THF, and two reagents. The vessel is placed on a magnetic stirrer and the magnetic stir bar is rotated below the threshold rotation speed, for example at 400 rpm, until the reagents recombine to generate the desired reactant. Once the desired reactant is obtained, the rotational speed of the magnetic stir bar is increased to the threshold rotational speed, for example 800 rpm, or above in order to quickly open the chamber and release the catalysts and the organic compound contained therein. Once the magnetic stir bar is in the open configuration, the rotational speed is for example reduced, for example to 400 rpm again, and the mixture is stirred with the magnetic stir bar in the open configuration until the desired synthesis by combination of the organic compound and the reactant is achieved.

FIG. 12 illustrates the same chemical reaction as on FIG. 11. In this case the organic compound is placed in a second chamber of the magnetic stir bar separated from the chamber containing the catalysts. The magnetic stir bar is for example pre-filled in a glove box at a remote location. The closed magnetic stir bar containing the catalysts and the organic compound is placed in a vessel containing a solvent, for example THF, and two reagents. The vessel is placed on a magnetic stirrer and the magnetic stir bar is rotated below the threshold rotation speed, for example at 400 rpm, until the reagents recombine to generate the desired reactant. Once the desired reactant is obtained, the rotational speed of the magnetic stir bar is increased to the threshold rotational speed, for example 800 rpm, or above in order to quickly open the chamber and release the catalysts and the organic compound contained therein. Once the magnetic stir bar is in the open configuration, the rotational speed is reduced, for example to 400 rpm again, and the mixture is stirred with the magnetic stir bar in the open configuration until the desired synthesis by combination of the organic compound and the reactant is achieved.

FIG. 13 illustrates the importance of the compartmentalisation of the chamber of the magnetic stir bar. Experiments have shown that mixing the organic compound with the catalysts in the same chamber of the magnetic stir bar, as shown by curve 11, inhibits the chemicals conversion and only the starting material is recovered. While separating the organic compound and the catalyst in two different chambers, as shown by curve 12, allowed achieving >99% of chemical conversion.

FIG. 14 illustrates the sealing efficiency of the magnetic stir bar. Experiments have shown that a magnetic stir bar filled with tricyclohexylphosphine allow a complete protection of this really sensitive chemical when stored in a protective vial. In an open flask the tricyclohexylphosphine oxidizes readily, as shown by curve 14*a*, its purity drops from >98% to 81% within 20 minutes. When the magnetic stir bar is stored outside such a protective vial, as shown by curve 14*b*, the catalyst purity only slightly decreases to 94% over 5 weeks. When stored in the protective vial, as shown by curve 14*c*, the purity level remains identical to the original sample stored in a glove box, as shown by curve 14*d*.

The invention claimed is:

1. Magnetic stir bar (1) for use with a magnetic stirrer, said magnetic stir bar (1) comprising:

at least one permanent magnet (2) for spinning said magnetic stir bar (1) when said magnetic stir bar (1) is subjected to a rotating magnetic field; and a chamber (3) for storing a product inside said magnetic stir bar (1), wherein said magnetic stir bar (1) has a closed configuration in which said chamber (3) is closed, said magnetic stir bar (1) being maintained in said closed configuration under the effect of a first force (f), and an open configuration in which said chamber (3) is open, said magnetic stir bar (1) being maintained in said open configuration under the effect of a second force (F); and wherein said magnetic stir bar (1) is adapted to automatically reconfigure itself from said closed configuration to said open configuration when said magnetic stir bar (1) is spun at or above a threshold rotational speed (ωt) and wherein said second force (F) is stronger than said first force (f).

2. Magnetic stir bar (1) according to claim 1, wherein said first force (f) and said second force (F) are magnetic forces induced by said at least one permanent magnet (2).

3. Magnetic stir bar (1) according to claim 1, wherein said threshold rotational speed (ωt) is comprised in a range going from 300 rpm to 1200 rpm.

4. Magnetic stir bar (1) according to claim 3, wherein said threshold rotational speed (ωt) is approximately 800 rpm.

5. Magnetic stir bar (1) for use with a magnetic stirrer, said magnetic stir bar (1) comprising:

at least one permanent magnet (2) for spinning said magnetic stir bar (1) when said magnetic stir bar (1) is subjected to a rotating magnetic field; and a chamber (3) for storing a product inside said magnetic stir bar (1), wherein said magnetic stir bar (1) has a closed configuration in which said chamber (3) is closed, said magnetic stir bar (1) being maintained in said closed configuration under the effect of a first force (f), and an open configuration in which said chamber (3) is open, said magnetic stir bar (1) being maintained in said open configuration under the effect of a second force (F); and wherein said magnetic stir bar (1) is adapted to automatically reconfigure itself from said closed configuration to said open configuration when said magnetic stir bar (1) is spun at or above a threshold rotational speed (ωt);

the magnetic stir bar further comprising a first part (10) and a second part (13)

detachable from said first part (10), wherein each part (10, 13) comprises:

at least one permanent magnet (2);

a cavity (31, 32) forming at least part of said chamber (3) when said magnetic stir bar (1) is in said closed configuration, wherein said at least one permanent magnet (2) of each part (10, 13) is positioned within said part (10, 13) such that they attract each other when said magnetic stir bar is in said closed position and when said magnetic stir bar is in said open position.

6. Magnetic stir bar (1) according to claim 5, wherein said at least one permanent magnet (2) of each part (10, 13) is positioned within said part (10, 13) such that said at least one magnet (2) in said first part (10) and said at least one magnet (2) in said second part (13) are closer to each other when said magnetic stir bar (1) is in said open configuration than they are when said magnetic stir bar (1) is in said closed configuration.

7. Magnetic stir bar according to claim 6, wherein said first part (10) and said second part (13) are configured such that a centrifugal force applied to said first part (10) and a centrifugal force applied to said second part (13), are equal to or greater than said first force (f) when said magnetic stir bar is spun at or above said threshold rotational speed (ωt).

8. Magnetic stir bar (1) for use with a magnetic stirrer, said magnetic stir bar (1) comprising:

at least one permanent magnet (2) for spinning said magnetic stir bar (1) when said magnetic stir bar (1) is subjected to a rotating magnetic field;

a chamber (3) for storing a product inside said magnetic stir bar (1);

tightening means (4) for hermetically closing said chamber (3) when said magnetic stir bar (1) is in said closed configuration, wherein said magnetic stir bar (1) has a closed configuration in which said chamber (3) is closed, said magnetic stir bar (1) being maintained in said closed configuration under the effect of a first force (f), and an open configuration in which said chamber (3) is open, said magnetic stir bar (1) being maintained in said open configuration under the effect of a second force (F); and wherein said magnetic stir bar (1) is adapted to automatically reconfigure itself from said closed configuration to said open configuration when said magnetic stir bar (1) is spun at or above a threshold rotational speed (ωt).

9. Magnetic stir bar (1) for use with a magnetic stirrer, said magnetic stir bar (1) comprising:

at least one permanent magnet (2) for spinning said magnetic stir bar (1) when said magnetic stir bar (1) is subjected to a rotating magnetic field; and a chamber (3) for storing a product inside said magnetic stir bar (1), wherein said magnetic stir bar (1) has a closed configuration in which said chamber (3) is closed, said magnetic stir bar (1) being maintained in said closed configuration under the effect of a first force (f), and an open configuration in which said chamber (3) is open, said magnetic stir bar (1) being maintained in said open configuration under the effect of a second force (F); and wherein said magnetic stir bar (1) is adapted to automatically reconfigure itself from said closed configuration to said open configuration when said magnetic stir bar (1) is spun at or above a threshold rotational speed (ωt) and wherein the chamber has a plurality of compartments that are separated from each other when said magnetic stir bar is in said closed configuration.

* * * * *